United States Patent [19]

Motohashi et al.

[11] 4,364,999

[45] Dec. 21, 1982

[54] HEAT SENSITIVE RECORD SHEET

[75] Inventors: Katsuichi Motohashi; Toshio Obara; Kazuo Kaneko; Masahiko Yamaguchi, all of Tokyo, Japan

[73] Assignee: Hodogaya Chemical Co., Ltd., Tokyo, Japan

[21] Appl. No.: 295,371

[22] Filed: Aug. 24, 1981

[30] Foreign Application Priority Data

Sep. 17, 1980 [JP] Japan ..... 55/127976

[51] Int. Cl.[3] ..... B41M 5/18

[52] U.S. Cl. ..... 428/411; 428/913; 428/914; 282/27.5; 106/21; 430/338; 549/394

[58] Field of Search ..... 430/338; 428/307, 411, 428/913, 327, 914; 282/27.5; 106/21; 260/336, 335; 427/151

[56] References Cited

U.S. PATENT DOCUMENTS 3,920,510 11/1975 Hatano et al. ..... 282/27.5

4,226,912 10/1980 Iwasaki et al. ..... 282/27.5

FOREIGN PATENT DOCUMENTS 1338851 11/1973 United Kingdom ..... 282/27.5

*Primary Examiner*—Won H. Louie, Jr.

*Attorney, Agent, or Firm*—Oblon, Fisher, Spivak, McClelland & Maier

[57] ABSTRACT

A heat sensitive record sheet comprises a coated layer comprising 2-(2-chlorophenyl)amino-6-di-propyl- or butyl-aminofluoran derivative.

3 Claims, No Drawings

HEAT SENSITIVE RECORD SHEET

BACKGROUND OF THE INVENTION

1. Field of the Invention

The present invention relates to novel fluoran derivatives. More particularly, it relates to a heat sensitive record sheet having a coated layer comprising a novel fluoran derivative which imparts color-development in black color as a color precursor.

2. Description of the Prior Art

Certain fluoran compounds have been disclosed in U.S. Pat. No. 3,746,562, U.S. Pat. No. 3,920,510 and Japanese Examined Patent Publication No. 23204/1976. When these fluoran compounds are used as color precursors for heat sensitive record sheet, there are disadvantages of the ground color density, the coloring initiation temperature and the rising for coloring. It is not possible to impart satisfactory effect for coloring in black on a heat sensistive record sheet. For example, 2-anilino-3-methyl-6-diethylaminofluoran disclosed in U.S. Pat. No. 3,746,562 partially colored in a preparation of the heat sensitive record paper to cause high ground color density of the heat sensitive record paper and a rising for coloring of the record paper is disadvantageously low. When 2-anilino-3-methyl-6-N-methyl-N-cyclohexylaminofluoran is used as disclosed in Japanese Examined Patent Publication No. 23204/1976, the rising for coloring of the heat sensitive record sheet is not satisfactory. On the other hand, when 2-(2-chlorophenyl)amino-6-diethylaminofluoran is used as disclosed in U.S. Pat. No. 3,920,510, the coloring initiation temperature is disadvantageously high though the ground color density is low and the rising for coloring is not satisfactory.

The rising for coloring means a rising of a curve in a diagram of color density-coloring temperature curve given by plotting color densities on the ordinate and coloring temperature on the abscissas as a value given by multiplying 100 to tan $\theta$ in the maximum slant of the curve.

SUMMARY OF THE INVENTION

It is an object of the present invention to provide a heat sensitive record sheet which has less ground color density and high coloring density, low coloring initiation temperature and excellent rising for coloring in black.

The foregoing and other objects have been attained by providing a heat sensitive record sheet which comprises a coated layer comprising 2-(2-chlorophenyl-)amino-6-di-propyl- or buty-aminofluoran derivative.

DETAILED DESCRIPTION OF THE PREFERRED EMBODIMENTS 2-(2-Chlorophenyl)amino-6-di-propyl- or butyl-aminofluoran derivative is stable in air and a colorless or slight colored solid and is changed into dark reddish black by contacting with an acidic material. The resulting reddish black pigment has excellent light fastness. Therefore, it is especially useful as a color precursor used for a heat sensitive record sheet which is colored in black.

The heat sensitive record sheet which colores in black in which 2-(2-chlorophenyl)amino-6-di-propyl- or butyl-aminofluoran derivative is used as a color precursor has less ground color density, excellent rising for coloring and remarkably low coloring initiation temperature.

It has been known that 2-hydroxybenzophenone derivatives, 2-(2-hydroxyphenyl)benzotriazol derivatives, isophthalate derivatives, and terephthalate derivatives, aliphatic acid amides are used as coloring assistants in record layers of the conventional heat sensitive record sheets. It is possible to use such coloring assistant in the heat sensitive record sheet using the fluoran derivative of the present invention.

An acidic material is usually combined with the fluoran derivative. The typical acidic materials include phenolic derivatives such as bisphenol A; and organic acids such as benzoic acid, salicyclic acid.

These components are preferably dispersed in each solution such as an aqueous solution of a binder. The binder can be water soluble or water dispersible binders such as polyvinyl alcohol, methyl cellulose, hydroxyethyl cellulose, carboxymethyl cellulose, gum arabic, starch, gelatin, casein, polyvinyl pyrrolidone, styrene, maleic acid copolymer, polyacrylic amide, polyacrylate, polyacrylic copolymer, terpene resin, petroleum resin and wax. The water soluble binder especially polyvinyl alcohol is preferably used.

It is usual to combine 0.1 to 3 preferably 0.3 to 1 of the coloring assistant, 2 to 10 preferably 4 to 6 of the acidic material and 0.3 to 3 preferably 0.5 to 1 of the binder per the fluoran derivative.

These coloring assistant, the acidic material, and the fluoran derivative are respectively dispersed by a ball mill, a sand mill or a paint conditioner, in an aqueous solution, an organic medium containing the binder preferably water to form each dispersion having a particle size of 1 to 6$\mu$ preferably 2 to 4$\mu$. If necessary, a defoaming agent, a dispersing agent or a whitening agent can be dispersed.

A heat sensitive record sheet using 2-(2-chlorophenyl) amino-6-diethylaminofluoran as the known coupler to color in black is compared with the heat sensitive record sheet of the present invention. As shown in Table 1, the heat sensitive record sheet using the fluoran derivative of the present invention had remarkably superior rising for coloring and remarkably lower coloring initiation temperature. Therefore, it is remarkably suitable for using it as a heat sensitive sheet for a facsimile especially a high speed facsimile.

TABLE 1

| Active ingredient | Rising for coloring | Coloring initiation temperature |
|---|---|---|
| 2-(2-chlorophenyl)amino-6-diethylaminofluoran (known compound) | 7.7 | 83.5° C. |
| 2-(2-chlorophenyl)amino-6-di-n-butylaminofluoran (Invention) | 10.0 | 81.0° C. |
| 2-(2-chlorophenyl)amino-6-di-n-propylaminofluoran (Invention) | 11.1 | 78.0° C. |

Note:
The rising for coloring and the coloring initiation temperature of each heat sensitive record paper having a heat sensitive record layer comprising each fluoran derivative, bisphenol A, polyvinyl alcohol and dimethyl terephthalate.

The 2-(2-chlorophenyl)amino-6-di-propyl: or butyl-aminofluoran derivative of the present invention can be produced by the following process (1) or (2).

PROCESS (1)

A reaction of a diphenylamine derivative with 2-(2-hydroxy-4-di-propyl- or butyl-aminobenzoyl) benzoic acid is performed in the presence of a condensing agent such as conc. sulfuric acid at a temperature of 0° to 80° C. for several to several tens hours. After the reaction, the reaction mixture is poured into water and an aqueous solution of sodium hydroxide is added to give pH of 8 to 10. The precipitate is separated by a filtration. The cake is admixed with an aqueous solution of sodium hydroxide (5 to 15%) and toluene. The mixture was stirred under refluxing for 1 to 3 hours. The toluene phase is separated and washed with water and concentrated. The precipitated crystal is separated by a filtration and is dried to obtain slightly colored 2-(2-chlorophenyl-)amino-6-di-propyl- or butyl-aminofluoran having high purity at high yield. If necessary, the product is washed with an alcohol such as methanol or ethanol or is recrystallized from a volatile inert organic solvent such as toluene, acetone and butyl acetate.

PROCESS (2)

A reaction of 2-amino-6-di-propyl- or butyl-aminofluoran with O-dichlorobenzene, 2-chlorobromobenzene, or 2-chloroiodobenzene is performed in a volatile inert organic solvent in the presence of copper powder and iodine as the catalysts to obtain 2-(2-chlorophenyl) amino-6-di-propyl- or butyl-aminofluoran. The process (1) is preferable in the production.

The typical diphenylamine derivatives used in the present invention include 4-hydroxy-2'-chlorodiphenylamine, 4-methoxy-2'-chlorodiphenylamine, and 4-ethoxy-2'-chlorodiphenylamine. It is especially preferable to use the derivative having alkoxy group at 4-position.

The 2-(2-hydroxy-4-di-propyl- or butyl-amino-benzoyl) benzoic acid used in the present invention can be 2-(2-hydroxy-4-di-n-propylamino-benzoyl)benzoic acid and 2-(2-hydroxy-4-di-n-butyl-amino-benzoyl)benzoic acid.

The typical aminofluoran derivatives used in the present invention can be 2-amino-6-di-n-propylamino-fluoran and 2-amino-6-di-n-butylaminofluoran.

The typical condensing agents used in the present invention include conc. sulfuric acid, acetic anhydride, phosphoric acid, polyphosphoric acid, phosphorous oxychloride and zinc chloride. It is especially preferable to use conc. sulfuric acid which is the condensing agent and also a solvent for the diphenylamine derivative and 2-(2-hydroxy-4-di-propyl- or butyl-amino-benzoyl)benzoic acid in view of the production.

Certain typical examples of the productions and the uses of the 2-(2-chlorophenyl)amino-6-di-propyl- or butyl-aminofluoran will be illustrated.

EXAMPLE 1

Production of
2-(2-chlorophenyl)amino-6-di-n-propylaminofluoran
(Compound 1)

Into 140 g. of 98% sulfuric acid, 15 g. of 2-(2-hydroxy-4-di-n-propylamino-benzoyl)benzoic acid (melting point of 187°–190° C.) was added and completely dissolved at room temperature and then, 10.3 g. of 4-methoxy-2'-chloro-diphenylamine was added to react them, at 20° C. for 48 hours and at 40° C. for 1 hour. After the reaction, the reaction mixture was poured into 400 ml. of ice water. The precipitate was separated by a filtration. The cake was admixed with 300 ml. of toluene and 200 g. of 10% aqueous solution of sodium hydroxide and the mixture was stirred under refluxing for 2 hours. The toluene phase was separated and washed with water. The toluene phase was dehydrated over anhydrous sodium sulfate and was concentrated. The precipitated crystal was separated by a filtration and dried to obtain 11.5 g. of white 2-(2-chlorophenyl)amino-6-di-n-propylaminofluoran having a melting point of 182°–185° C.

The result of the elemental analysis of the fluoran derivative is as follows: This is substantially identical to the calculated value within allowance:

| | C (%) | H (%) | Cl (%) | N (%) | O (%) |
|---|---|---|---|---|---|
| Calculated | 73.33 | 5.38 | 6.76 | 5.35 | 9.16 |
| Found | 73.4 | 5.3 | 6.6 | 5.5 | 9.2 |

EXAMPLE 2

Production of
2-(2-chlorophenyl)amino-6-di-n-butylaminofluoran
(Compound No. 2)

Into 180 g. of 98% sulfuric acid, 19.0 g. of 2-(2-hydroxy-4-di-n-butylamino-benzoyl)benzoic acid (melting point of 182°–184° C.) was added and completely dissolved at about 30° C. and then, 13.2 g. of 4-methoxy-2'-chlorodiphenylamine was added to react them at 20°–25° C. for 1 hour and at 40° C. for 7 hours. The reaction mixture was poured into 1 liter of ice water and an aqueous solution of sodium hydroxide was added to give pH of higher than 10. The precipitate was separated by a filtration and the cake was admixed with 450 ml. of toluene and 340 g. of 10% aqueous solution of sodium hydroxide and the mixture was stirred under refluxing for 2 hours. The toluene phase was separated and washed with water and toluene was distilled off by a steam distillation. The precipitated crystal was separated by a filtration. The cake was washed with methanol and the crystal was separated by a filtration and was dried to obtain 20 g. of pale pink 2-(2-chlorophenyl) amino-6-di-n-butylaminofluoran having a melting point of 181°–183° C.

The result of the elemental analysis of the fluoran derivative is as follows: This is substantially identical to the calculated value within allowance.

| | C (%) | H (%) | Cl (%) | N (%) | O (%) |
|---|---|---|---|---|---|
| Calculated | 73.96 | 5.84 | 6.42 | 5.07 | 8.69 |
| Found | 74.0 | 5.7 | 6.5 | 5.1 | 8.7 |

USES (1) In a ball mill, 4 g. of 2-(2-chloroanilino)-6-di-n-butylaminofluoran and 40 g. of 10% aqueous solution of polyvinyl alcohol were dispersed and milled for 48 hours to obtain a suspension (A) having a particle diameter of 2–3μ.

In a ball mill, 7 g. of bisphenol A, 40 g. of 10% aqueous solution of polyvinyl alcohol and 10 g. of water were dispersed and milled for 48 hours to obtain a suspension (B) having a particle diameter of 2–3μ.

In a ball mill, 7 g. of dimethylterephthalate, 40 g. of 10% aqueous solution of polyvinyl alcohol and 10 g. of water were dispersed and milled for 48 hours to obtain a suspension (C) having a particle diameter of 2–3μ.

The suspensions (A), (B) and (C) were mixed at ratios of 3:10:3 by weight to obtain a coating composition for a heat sensitive coating. The composition was coated on a high quality paper by #10 wire bar at a content of 5 g/m² as a dry solid, and the coated paper was dried in a dryer equipped with a blower to dry at room temperature to obtain a heat sensitive record paper (1).

(2) In a ball mill, 4 g. of 2-(2-chloroanilino)-6-di-n-propylaminofluoran and 40 g. of 10% aqueous solution of polyvinyl alcohol were dispersed and milled for 48 hours to obtain a suspension (D) having a particle diameter of 2–3μ.

The suspension (D) and the suspensions (B) and (C) prepared in the process (1) were mixed at ratios of 3:10:3 by weight and a heat sensitive record paper (2) was prepared in accordance with the process (1).

(3) In a ball mill, 4 g. of 2-(2-chloroanilino-6-diethylaminofluoran and 40 g. of 10% aqueous solution of polyvinyl alcohol were dispersed and milled for 48 hours to obtain a suspension (E) having a particle diameter of 2–3μ.

The suspension (E) and the suspensions (B) and (C) prepared in the process (1) were mixed at ratios of 3:10:3 by weight to prepare a coating composition for a heat sensitive coating. The composition was coated on a high quality paper by #10 wire bar at a content of 5 g/m² as a dry solid and the coated paper was dried in a dryer equipped with a blower to dry at room temperature to obtain a heat sensitive record paper (3).

(4) In a ball mill, 4 g. of 2-anilino-3-methyl-6-diethylaminofluoran and 40 g. of 10% aqueous solution of polyvinyl alcohol were dispersed and milled for 48 hours to obtain a suspension (F) having a particle diameter of 2–3μ.

The suspension (F) and the suspensions (B) and (C) prepared in the process (1) were mixed at ratios of 3:10:3 by weight and a heat sensitive record paper (4) was prepared in accordance with the process (1).

(5) In a ball mill, 4 g. of 2-anilino-3-methyl-6-N-methyl-N-cyclohexylaminofluoran and 40 g. of 10% aqueous solution of polyvinyl alcohol were dispersed and milled for 48 hours to obtain a suspension (G) having a particle diameter of 2–3μ.

The suspension (G) and the suspensions (B) and (C) prepared in the process (1) were mixed at ratios of 3:10:3 by weight and a heat sensitive record paper (5) was prepared in accordance with the process (1).

The following tests of these heat sensitive record papers were carried out.

① TEST FOR COLORING OF HEAT SENSITIVE RECORD PAPER

Rhodiaceta type thermotester (French Public Fiber Research Lab.) was used at a heating temperature of 170° C. for 3 seconds under a load of 100 g/cm² to measure a color density in the heat-coloring.

Macbeth reflex densitometer RD-514 type with a black filter (Wratten #106) was used to measure ground color density for the heat sensitive record papers (1) to (5).

② TEST FOR COLORING CHARACTERISTIC OF HEAT SENSITIVE RECORD PAPER (1) TO (5)

Each of the heat sensitive record papers (1) to (5) was heated by the method ① at 70° to 170° C. to impart colors and each color density at each temperature was measured by the method ①. Each coloring intiation temperature and each rising for coloring were calculated from the data for the relation of the temperature and the color density.

The results of ① the tests for coloring and ② the tests for coloring characteristics are shown in Table 2.

TABLE 2

| | Coloring and coloring characteristics of heat sensitive record paper: Heat sensitive record paper fluoran derivative | Record paper |
|---|---|---|
| Invention | 2-(2-chlorophenyl)amino-6-di-n-butyl-aminofluoran | (1) |
| | 2-(2-chlorophenyl)amino-6-di-n-propyl-6-aminofluoran | (2) |
| Reference | 2-(2-chlorophenyl)amino-6-diethylamino-fluoran | (3) |
| | 2-anilino-3-methyl-6-diethylaminofluoran | (4) |
| | 2-anilino-3-methyl-6-N—methyl-N—cyclo-hexylaminofluoran | (5) |

TABLE 2'

| Record paper | Coloring: hue | Coloring: color density | Coloring: ground color density | Coloring characteristic: coloring initiation temp. | Coloring characteristic: rising for coloring |
|---|---|---|---|---|---|
| (1) | RB | 1.32 | 0.09 | 81° C. | 10.0 |
| (2) | RB | 1.30 | 0.08 | 78° C. | 11.1 |
| (3) | RB | 1.31 | 0.09 | 83.5° C. | 7.7 |
| (4) | RB | 1.29 | 0.14 | 80° C. | 5.9 |
| (5) | RB | 1.30 | 0.12 | 79° C. | 7.1 |

Note:
RB: reddish black
The rising for coloring was measured by the equation: rising for coloring = 100 × tan θ wherein tan θ is in the maximum slant of the color density - coloring temperature curve.

The following fact is found from the results of ① the test for coloring and ② the test for coloring characteristics.

The heat sensitive record paper using the fluoran derivative of the present invention for black is superior to the reference heat sensitive record papers using the other fluoran derivatives in the total characteristics especially it has excellent rising for coloring as the important function in the practical use. It is confirmed to be the excellent record paper.

We claim:

1. A heat sensitive record sheet which comprises a coated layer comprising 2-(2-chlorophenyl)amino-6-di-propyl- or butyl-aminofluoran.

2. The heat sensitive record sheet according to claim 1 wherein said coated layer comprises 2-(2-chlorophenyl)amino-6-di-n-propylaminofluoran.

3. The heat sensitive record sheet according to claim 1 wherein said coated layer comprises 2-(2-chlorophenyl)amino-6-di-n-butylaminofluoran.

* * * * *